United States Patent [19]

Grubbs

[11] Patent Number: 4,575,126

[45] Date of Patent: Mar. 11, 1986

[54] SPECIAL PROJECT WORKBOOK

[76] Inventor: James B. Grubbs, 6409 Greenhaven Dr., Sacramento, Calif. 95831

[21] Appl. No.: 495,856

[22] Filed: May 18, 1983

[51] Int. Cl.[4] ..... B42F 21/00; B42F 17/06; B42F 17/00; B42D 3/00

[52] U.S. Cl. ..... 283/38; 283/42; 281/31; 40/393

[58] Field of Search ..... 283/38, 39, 42; 281/31, 281/45; 402/29, 24, 500; 40/358, 393, 405, 537

[56] References Cited

U.S. PATENT DOCUMENTS

| | | | |
|---|---|---|---|
| 458,394 | 8/1891 | Higgins | 402/29 |
| 467,205 | 1/1892 | See . | |
| 538,487 | 4/1895 | Gremmel et al. . | |
| 556,842 | 3/1896 | Browning | 40/358 |
| 585,408 | 6/1897 | Sheppard | 283/42 |
| 708,230 | 9/1902 | Huber . | |
| 886,320 | 4/1908 | Ferrero . | |
| 1,119,768 | 12/1914 | Thomas | 40/537 |
| 1,484,827 | 2/1924 | Heend . | |
| 1,819,429 | 8/1931 | Manzler | 283/42 |
| 1,830,886 | 10/1931 | Rand | 40/405 |
| 2,068,262 | 6/1937 | Brown | 40/393 |
| 2,329,351 | 9/1943 | Korvin-Kroukovsky | 402/24 |
| 2,452,449 | 10/1948 | Forsyth . | |
| 2,931,667 | 4/1960 | Schuessler . | |
| 2,936,680 | 5/1960 | Copen . | |
| 3,227,491 | 1/1966 | Coniker | 281/31 |
| 3,473,246 | 10/1969 | Parobek . | |
| 3,958,816 | 5/1976 | Rommey, III | 283/42 |
| 4,193,704 | 3/1980 | Miller et al. | 402/500 |
| 4,196,536 | 4/1980 | Westberg . | |
| 4,345,394 | 8/1982 | Sullivan . | |
| 4,401,323 | 8/1983 | Rex | 281/45 |

FOREIGN PATENT DOCUMENTS

| | | | |
|---|---|---|---|
| 2248693 | 10/1973 | France | 283/31 |

*Primary Examiner*—Paul A. Bell
*Assistant Examiner*—Paul M. Heyrana, Sr
*Attorney, Agent, or Firm*—Nilsson, Robbins, Dalgarn, Berliner, Carson & Wurst

[57] ABSTRACT

A workbook is provided for the organization of projects and for the maintaining of informational data regarding individuals in a readily available form. A plurality of alphabetically-ordered information cards are releasably attached to the workbook and are adapted to record the names and general long-term data regarding the individuals, and a plurality of pockets are adapted to retain identification cards which identify certain of the individuals, such as by serving as a prompt regarding specific occurrences or allowing the recordation of specific data regarding short-term projects. The data may then be summarized and retained on the information cards to provide both short- and long-term records.

4 Claims, 9 Drawing Figures

SPECIAL PROJECT WORKBOOK

FIELD OF THE INVENTION

This invention relates generally to the art of maintaining informational data, and more particularly relates to data recording devices for maintaining information regarding a number of individuals who must be contacted periodically.

BACKGROUND AND SUMMARY OF THE INVENTION

In working on a project where a large number of individuals are to be contacted, it is often very difficult to organize the task into a usable format so that the worker may approach the project in an orderly fashion. For example, if a person wishes to record a substantial amount of information regarding a number of individuals and to make contacts regarding each of the individuals at various times during the year, a compact device or system to maintain the information and provide prompts regarding the timing of the contacts would be particularly desirable. Similarly, where information regarding a large number of identified individuals must be maintained, and a limited number of the individuals contacted or dealt with extensively during a relatively short period of time, it would be advantageous to have a device or system which would allow the retention of permanent information regarding each individual in readily available form, as well as the separate maintenance of information which is relevant primarily to the particular short-term project and is then summarized, if required, and retained with the permanent information.

The present invention attains the described objectives by providing a workbook or portfolio which contains a plurality of alphabetically-ordered information cards releasably attached to the workbook, the information cards including linear indicia adapted to permanently record the names and other data regarding the individuals, and a plurality of pockets for retaining cards which identify certain of said individuals to be contacted within a limited period of time.

The portfolio may include a first and second portion hingedly connected in book-like form along a binder portion therebetween, in a manner commonly known as a loose leaf workbook or notebook. A plurality of alphabetically-ordered information cards are releasably attached to the binder portion such as by apertures which receive rings in the binder portion. In this manner, the information cards may occasionally be inserted or withdrawn as the need arises, yet are generally securely retained within the portfolio. The cards overlie a portion of the portfolio and include linear indicia adapted to permanently record the names and other data regarding the individuals to be contacted. Further, there is included a plurality of pockets disposed in another portion of the portfolio, the pockets adapted to retain project or identification cards regarding the contacting of certain of the individuals within a particular period of time. The project or identification cards can relate to any undertaking to deal with or contact an individual listed on an information card.

For example, the workbook may be employed by a stockbroker or real estate agent to retain information regarding a large number of clients, most of whom are contacted infrequently regarding projects which require intensive effort or communication over a relatively short period of time.

For this purpose, the names of the clients, or individuals whom the user may wish to contact, are entered on alphabetically-ordered cards along with particular information regarding the individual. Such information may comprise personal information about the individual, such as business and home addresses and telephone numbers, spouse's name, hobbies and interests as may be desired by the person in the course of anticipated conversations with the individual. In addition, the alphabetical information cards also contain spaces to insert summaries of previous contacts so that the user may easily determine the nature of the last contact with the individual. For example, with the portfolio of the present invention at hand, the user may instantly determine the substance of the last interaction with the individual even though many years have since elapsed. This is particularly advantageous when a provider of professional services receives a telephone call from a former client, since the recall of past interactions by the professional may provide increased client confidence.

When the workbook user enters into a specific project with an individual listed in the alphabetical section, the basic information required for the project is transferred from the information card to a project card which is inserted into one of the plurality of pockets in the workbook. The project card is used to keep a record of the specific details of the project, e.g. calls which have been made, calls received and the next task to be performed. When the specific project is completed, the matter on the project card is summarized and sufficient data is retained on the alphabetically-ordered information card so that a prompt regarding the nature of the project is readily available as described.

With regard to the employment of the present invention by real estate agents, for example, the information cards could record a potential client's name and family size, in addition to information with regard to the type of house owned and the type of house desired. From an initial contact with the individual, which may involve an inquiry regarding a listed property, details regarding the type and location of the listed house may be recorded on the project card, as well as details with respect to negotiations with the seller, dates for response to offers and, if successful, details with regard to the seller's and buyer's duties regarding transfer. While many of these details are specific for the particular project and need not be entered in the alphabetical cards, sufficient information regarding the interaction may be summarized on the information cards to allow the real estate agent to instantly recall the individual and the specific project as required. With respect to stockbrokers, the workbook of the present invention is particularly useful, not only to provide the advantages hereinbefore described, but the project cards bearing specific information with regard to sales and purchases may be retained in card files, as the maintenance of such detailed records is often required by law.

The portfolio may also include a daily schedule of sequential calendar sheets which is adapted for the recording of prearranged communications to be made with certain individuals. For example, if an individual is contacted and requests the project person to call at a more convenient time or, if the individual is unavailable for a certain time period, a prearranged call-back date may be recorded on the appropriate calendar sheet. Thus, as work on the project progresses and call-backs accumulate, a majority of the calls to be made on a particular day may be viewed by turning to the appropriate daily calendar sheet.

In addition, a daily call record of sequential sheets may be attached to one of the portions of the portfolio and adapted for the recording of communications made on a particular day and the results of each communication, e.g. the total calls made and the number of calls which resulted in an affirmative or negative response to the solicitation made.

In another aspect of the invention, the alphabetically-ordered information cards may include a detachable portion to record the individual's birthday or to denote other occurrences of importance to the individual, which portion is completed when the initial entry on the information card is made. Upon insertion into the alphabetically-oriented section, the occasion-denoting portion is detached and filed in an occasion or prompt portion of the workbook by the date of the occasion. In this aspect, the portfolio is provided with twelve pockets and the detached portions may be retained therein as identification cards which are filed in the pockets according to the month of the occasion or, with twenty-four or twenty-six pockets according to shorter time periods in order to provide prompts regarding individual's birthdays, particular goods requested by a prospective buyer, or other occasions. Thus, at the beginning of any given time period, the birthdays or other occasions relating to individuals or customers may be noted and arrangements may easily be made to send greeting cards or other observances to the proper individuals. Depending upon the intended use of the project book or the number of individuals involved, different numbers of pockets may be provided, e.g. seven or thirty-one pockets if a large number of contacts are to be made in a week or month, respectively.

In the following description, two particular non-restrictive embodiments of a workbook according to the invention are described, with reference to the attached drawings in which.

Figure 1:
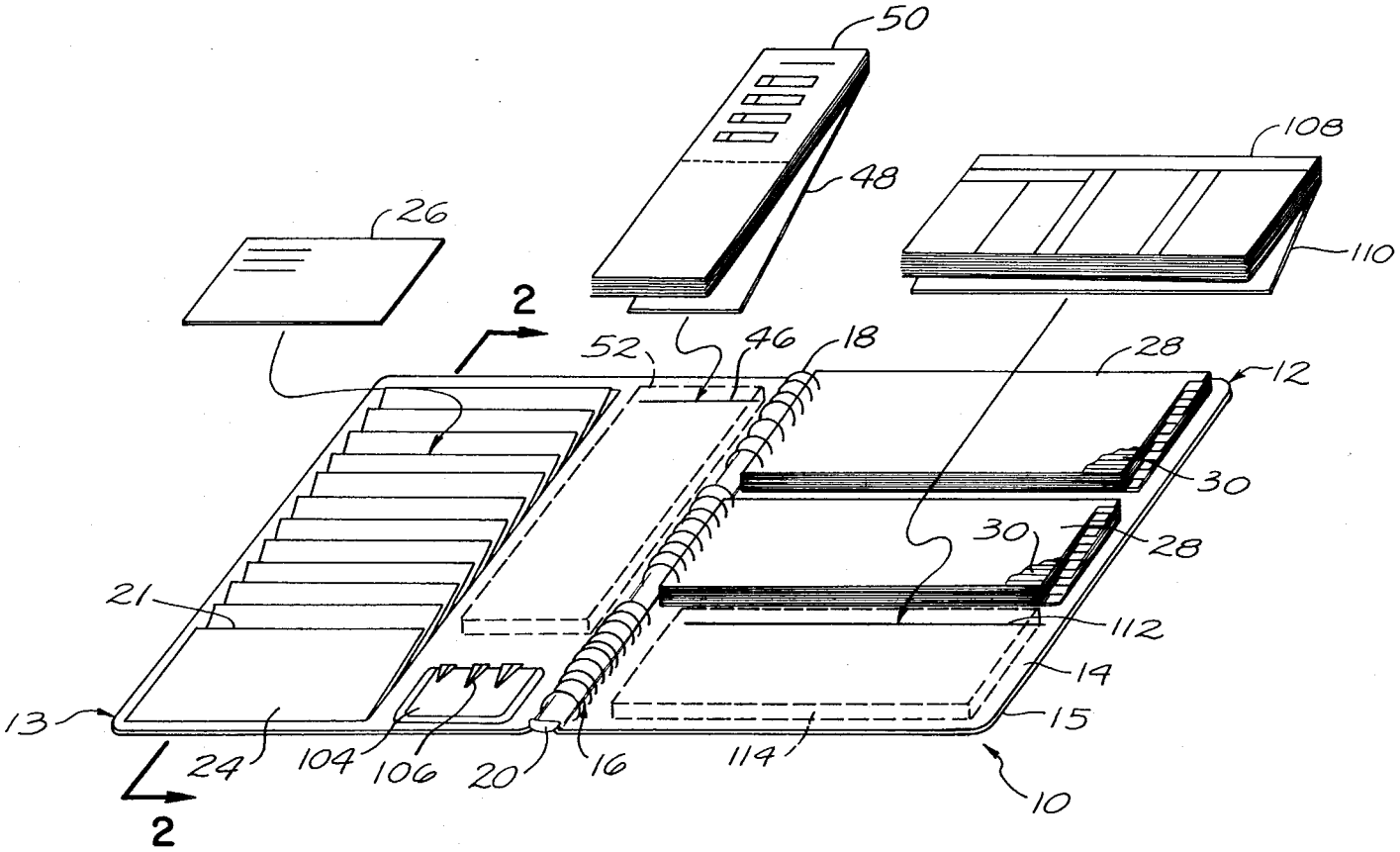
FIG. 1 shows a partially exploded perspective view of the special project workbook of the present invention.
Figure 5A:
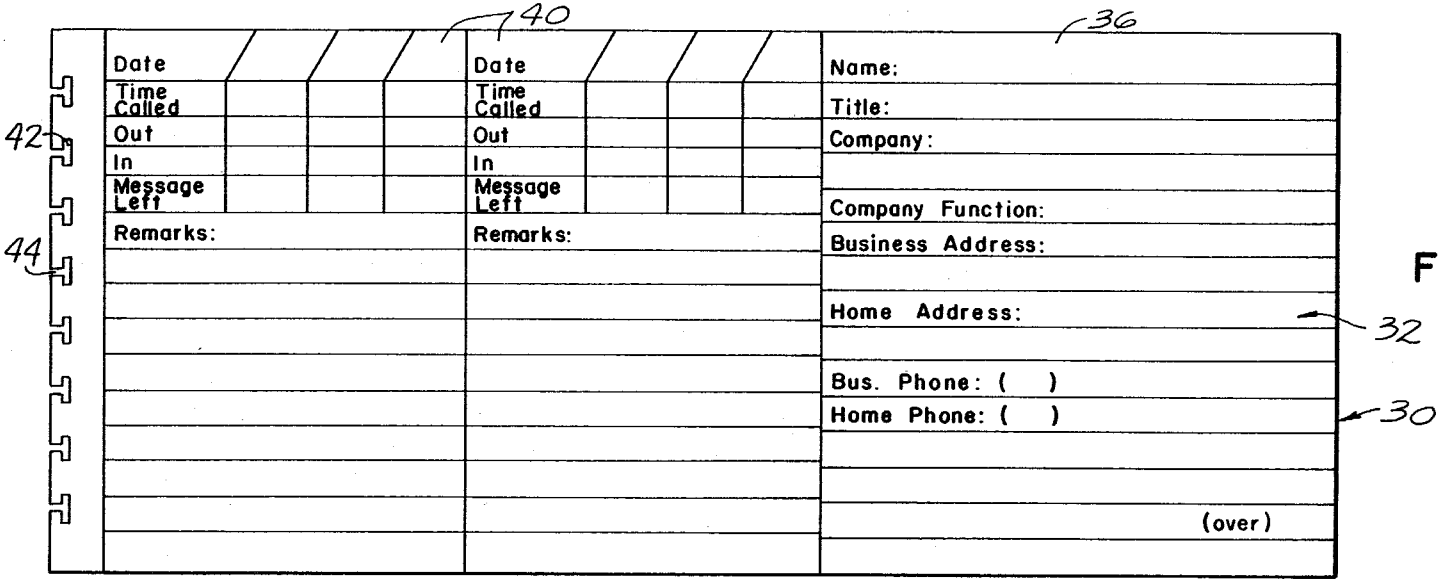
Figure 5B:
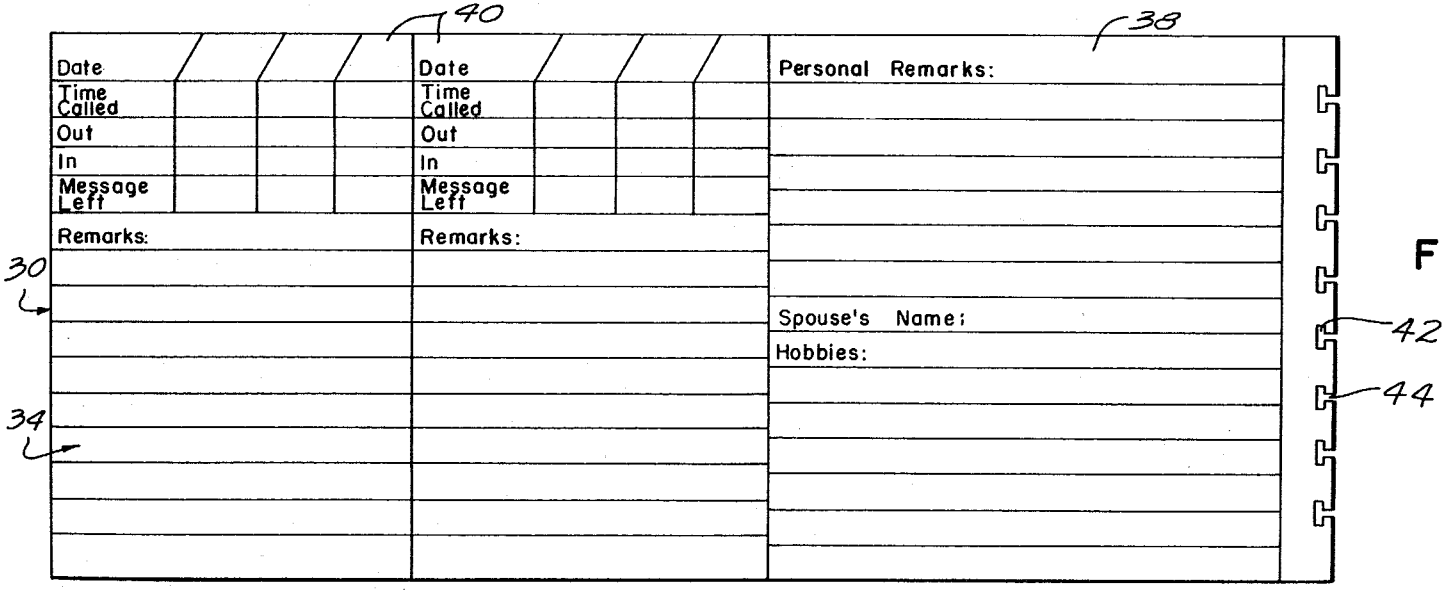
Figure 6:
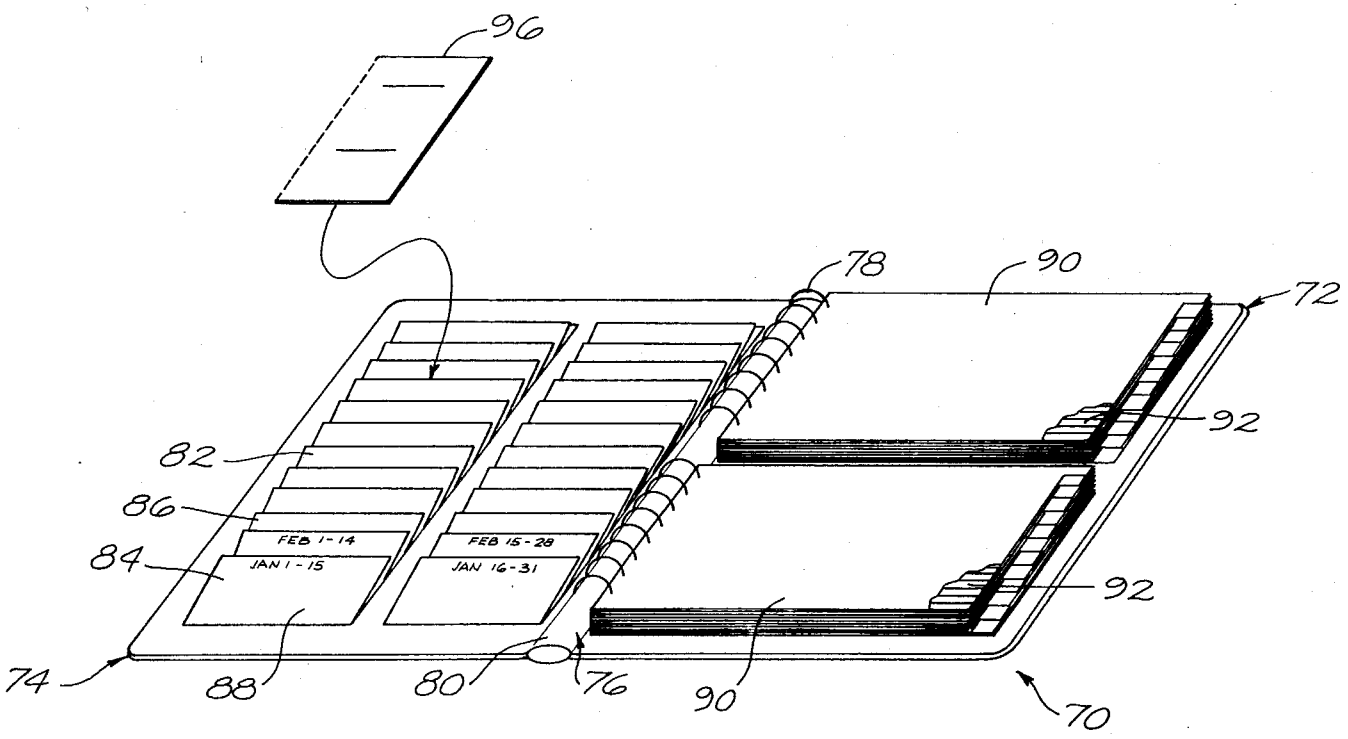
Figure 7A:
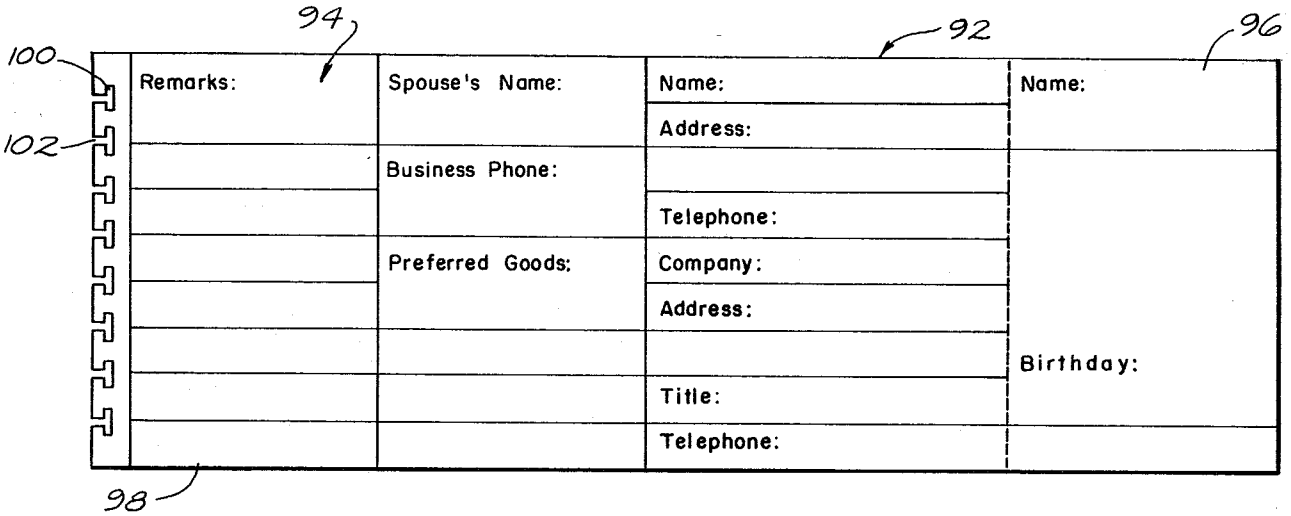
Figure 7B:
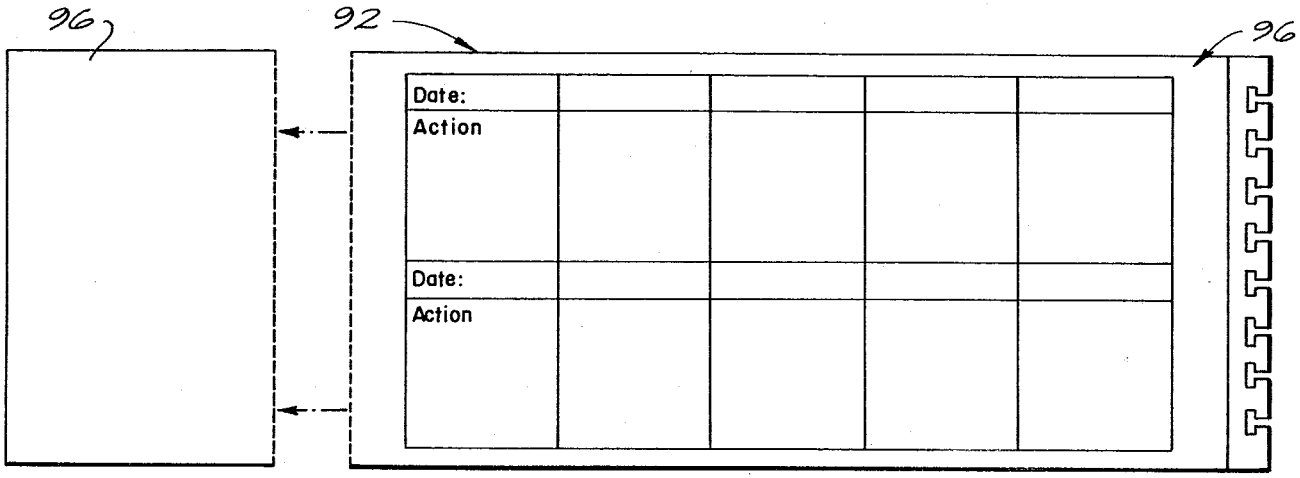

FIGS. 5*a* and 5*b* are elevational views of the first and second sides of the alphabetically-ordered information cards of the workbook of FIG. 1;

FIG. 6 is a perspective view of an occasion project workbook according to the present invention; and FIG. 7 shows elevational views of the alphabetically-ordered information cards of the occasion book of claim 6 wherein FIG. 7*a* shows the first or front side thereof and FIG. 7*b* the second or rear side.

DETAILED DESCRIPTION

Referring now again more particularly to the drawings and to FIG. 1 thereof, a special project workbook, designated generally by reference numeral 10, is seen to include a first portion 12 and a second portion 13, each having an inside layer 14 and an outside layer 15 and a binder portion 16 therebetween. The portions 12 and 13 may be constructed of polymeric material, cardboard, leather or other material known in the art and appropriate for the construction of workbooks or portfolios. The binder portion 16 is constructed partially of the same material used to construct the portions 12 and 13, and is hingedly attached to said portions along the edges of the binder. The binder 16 further includes a plurality of flat rings 18 mounted on the binder 16 by a metal bracket 20 as is known in the art. The rings 18, having a rectangular aspect in cross-section, have a particular advantage with respect to the alphabetical information cards as hereinafter described. The bracket 20 may also include a tab and mechanism, not shown, to enable the opening of the rings 18 in the manner found in loose-leaf notebooks.

Figure 2:
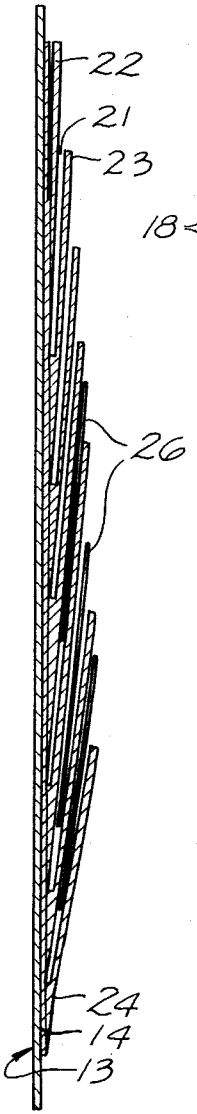
FIG. 2 is a cross-sectional view taken along the plane indicated by line 2—2 of FIG. 1, and illustrating one form of the construction of the pockets of the workbook.

Turning now to FIG. 2, the second portion 13 is seen to include a plurality of pockets represented by an upper pocket 21, said pockets having walls of unequal height 22 and 23 and being formed from a single sheet of material 24 which is adhesively attached to the portion 14 or by other appropriate means. The pockets 21 are seen to contain a plurality of identification cards 26, for purposes herein described. The number of pockets 21 contained in the portion 13 may vary as required by the particular project for which the workbook 10 is employed, and by the size of the cards 26 therein. For example, in a project requiring a large number of calls of short duration, additional pockets may be required, or a smaller number of larger pockets may be provided to retain a large number of project cards. If the cards 26 are larger or smaller than those presented in this embodiment, the pockets 21 may be correspondingly adjusted in size.

In FIG. 1, the portion 12 is seen to include a plurality of alphabetical indexing dividers 28 with alphabetically-ordered information cards 30 disposed therebetween.

FIGS. 5*a* and 5*b* depict, respectively, a first side 32 and a second side 34 of the information cards 30. The first side 32 is seen to include a professional information section 36 which may be specifically designed with regard to the type of project undertaken. In this example, name, job information as well as business and home addresses and phone numbers, are recorded. The second side 34 includes a personal information section 38 wherein personal data which may be of assistance to the project worker may be recorded. The sides 32 and 34 further contain a plurality of call record sections 40 to enable the project worker to maintain a permanent record of the date, time and results of repetitive calls to each individual.

The information card 30 is seen to include, at a portion proximal the binder portion 16, a plurality of binder ring apertures 42 adapted to receive the binder rings 18 to enable the retention of the cards 30 permanently within the notebook 10. As shown in FIG. 5, the apertures 42 are seen to include an access opening 44 to constitute a slotted aperture and to enable the rings 18 to be forceably inserted or withdrawn without opening the rings 18, yet allow the permanent retention of the cards 30 within the workbook 10. It should be noted that according to the described method, periodic insertion and/or removal of the information cards is required, and opening and closing the binder rings for this purpose is particularly inconvenient if large numbers of such cards are retained within the workbook 10. Thus, the form of the apertures 42 is particuarly useful in the present invention. Since they are seldom removed, the indexing dividers 28 are provided with non-accessible binder ring apertures, not shown.

Returning now to FIG. 1, the portion 13 is seen to include a slot 46 formed in the inside layer 14 thereof, and adapted to receive a rigid back portion 48 of a daily call record 50 therein. When the back portion 48 is inserted into the slot 46, the call record 50 is seen to occupy the position detailed by phantom lines 52 in FIG. 1, i.e. overlying an inner section of the portion 13.

Figure 4:
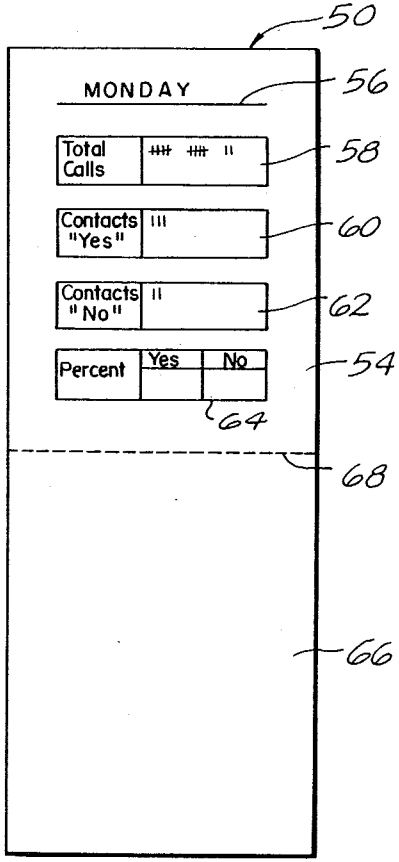
FIG. 4 is an elevational view of one of the sequential sheets in the daily call record of the workbook of FIG. 1.
Figure 3:
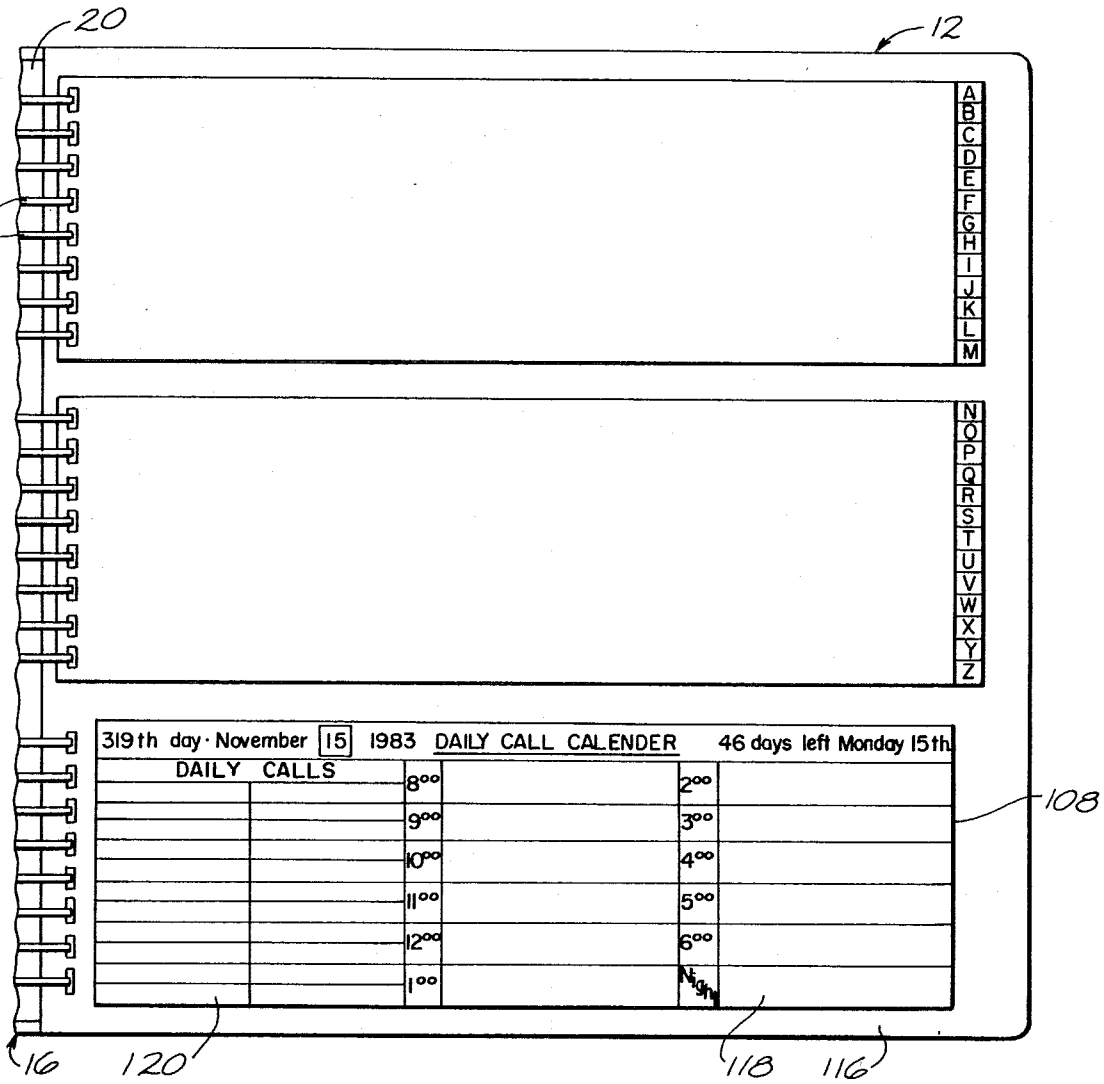
FIG. 3 is an elevational view of one portion of the workbook shown in FIG. 1.

The record 50 is seen to include a plurality of sequential sheets in tablet form. As is shown in FIG. 4, the call record 50 is adapted for the recording of communications made on a particular day and the results of each communication. In this instance, a facing sheet 54 is seen to be labelled, at the top thereof, with the day of the week as well as a line 56 wherein the date may be recorded. Therebelow, a space 58 is provided for the recordation of the total calls made on a particular day by sequential markings at the time of the call. Spaces 60 and 62 are also provided wherein the results of each call may be recorded by sequentially marking affirmative responses in the space 60 and negative responses in the space 62. At the end of a working day, the markings in the spaces 58, 60 and 62 may be counted and tallied and the percentage of affirmative and negative responses may be recorded in the space represented by reference numeral 64. Thus, at the end of each day the facing sheet 54 of the call record 50 may be detached and retained elsewhere to enable periodic efficiency reviews, and the next sequential sheet is revealed to enable the recordation of the next day's contacts. In FIG. 4, the sheet 54 is also seen to include a bottom portion 66 attached thereto by a series of perforations 68, by which the portion 66 may be detached therefrom. The portion 66 may be used for the inscription of temporary notes or other information recorded during telephone calls, which may later be inserted in the information cards 30.

Turning now to FIG. 6, an occasion project workbook, designated generally by reference numeral 70, is seen to include a first portion 72 and a second portion 74, and a binder portion 76 therebetween. The portions 72 and 74 may be constructed of polymeric material, cardboard, leather or other material as heretofore described with regard to the special project workbook 10. The binder portion 76 is constructed partially of the same material used to construct the portions 72 and 74, and is hingedly attached to said portions along the longitudinal edges of the binder. The binder portion 76 further includes a plurality of flat rings 78 mounted on the binder 76 by a metal bracket 80 for the purposes set forth with regard to the rings 18 and bracket 20 described in FIG. 1.

The second portion 74 is seen to include a plurality of pockets represented by the pocket 82, the pocket 82 having walls of unequal height 84 and 86 and being formed from a single sheet of material 88 attached to the portion 74 adhesively or by other appropriate means. Aside from the number of pockets as shown in the project book 70, i.e. two columns having twelve pockets each, the pockets are constructed in a manner similar to that shown with regard to the pockets 21 in FIG. 2.

The portion 72 is seen to include a plurality of alphabetical indexing dividers 90 with alphabetically-ordered information cards 92 disposed therebetween.

FIGS. *7a* and *7b* depict, respectively, a first side 94 and a second side 96 of the information card 92. Prior to insertion into the workbook 70, the cards 92 are seen to include a detachable portion 96, shown attached to the card 92 in FIG. *7a* and detached therefrom in FIG. *7b*. The first side 94 is seen to include linear indicia for the recordation of the information required for the specific type of project undertaken. In this example, name, business and home addresses and telephone numbers, spouse's name and information regarding the goods or products desired by the individual may be recorded. In addition, a space 98 is seen to be included to permit the entry of additional information which may be required with regard to the particular individual.

The detachable portion 96 is seen to include indicia to permit the recording of the individual's name and the occasion to be remembered, in this instance, the anniversary of the individual's birthday.

The information card 92 is seen to include, at a portion proximal the binder portion 16, a plurality of binder ring apertures 100 adapted to receive the binder rings 78 to enable the retention of the cards 92 permanently within the notebook 70. The apertures 100 are seen to include an access opening 102 to constitute a slotted aperture and to enable the rings 78 to be forceably inserted or withdrawn without opening the rings 78, as described in more detail with regard to the information cards 30 and the rings 18 heretofore described, with the advantages attendant thereto.

With regard to the project book 70, a retailer or professional may, upon initial contact with a customer or client, insert the required information on the main body of the card 92 as well as the detachable portion 96 thereof, and detach the portion 96 from the card 92. Thereafter, the card 92 may be inserted into the workbook 70 at the appropriate place among the alphabetically-ordered index cards 90, and the detached portion 96 is inserted into an appropriate pocket 82. In this regard, the number of pockets 82 is determined by the particular occasion noted and the number of individuals involved. In this instance, each of the detached portions 96 are inserted into an appropriate pocket 82 as determined by the date of the individual's birthday, as shown in FIG. 6.

Thus, as the particular time period by which the cards are separated approaches, the user removes the portions 96 from the particular pocket and is thus capable of instantaneously identifying the customers or clients having birthdays within that time period, e.g. from January 1st through January 15th. With this information, the user may then peruse the information card 92 which contains the information necessary to undertake the action desired. For example, the user may then send a greeting card to the individual, arrange for the delivery of preferred gifts or contact the individual's spouse with regard to arrangements for the celebration of the occasion. In this manner, the detached portions 96 serve as prompts to allow the user to identify individuals to be contacted with regard to an occasion, and the information cards 92 serve as a permanent record of information regarding the individual and his or her preferences. It should be noted in FIG. *7b*, that the second side of the card 92 is seen to include space for the entry of information regarding the date and type of action taken with regard to previous occasions, and thus the user is enabled to determine the appropriate action from previous years.

In other embodiments, the occasion workbook shown in FIGS. 6 and 7 may be used to provide prompts with regard to other occurrences. For example, a retailer, dealing in goods which are in short supply, may complete the information card in an occurrence book which is similar to the card 92 herebefore described when a customer indicates a desire to purchase a product not then in stock. In this regard, the detachable portion 96 of the card 92 would contain the individual's name and the type of good desired, and the portions 96 would be inserted into an appropriate pocket 82 which is labelled according to the product desired. When a shipment of such products arrives, the retailer may instantly identify the individuals who have, during the period of time when such product was unavailable, indicated a desire to purchase same. Then, by turning to the information cards, additional data regarding the individual may be determined and the appropriate contact made.

Returning again to FIG. 1, the workbook 10 is seen to include a pocket 104 adapted to retain a plurality of clips 106 which may be useful in either of the workbooks heretofore described. It is preferred that clips be employed having differential colors, i.e. red and blue, and be of the type known and sold under the trademark PLASTIKLIPS by Baumgarten's of Atlanta, Ga. The clips 106 are used to identify specific activity with regard to any of the cards or portions thereof heretofore described. For example, a single red clip 106 may be included to enable the user to identify, when work on a specific task is interrupted, the next card or portion to be taken up when the task is resumed. A plurality of clips 106 of a different color, e.g. blue, may be employed to denote individuals to be contacted at the beginning of a succeeding working day, i.e. individuals who are not contacted during the previous day in a first attempt, or individuals who requested to be called back at a later date. Through the use of the clips 106, a user may easily determine at the beginning of each working day the point in a series of cards where work should begin, and the repeat calls which must be made.

With regard to the scheduling of tasks and calls discussed with regard to the clips 106, the special project workbook 10 may further include a daily call calendar 108 which is seen to include a rigid back portion 110 which is received in a slot 112 formed in the inside layer 14 of the portion 12. When the back portion 110 is inserted into the slot 112, the call calendar 108 is seen to occupy the position detailed by the phantom lines 114 in FIG. 1, i.e. overlying a bottom section of the portion 12. The call record 108 is seen, in FIG. 1, to include a plurality of sequential sheets in tablet form. In this instance, a facing sheet 116 is seen to be labelled, at the top thereof, with indicia regarding a particular day and date of a year. The sequential sheets lying below the facing sheet 116 should be understood to correspond to sequential days thereafter. Therebelow, a right-hand portion 118 is provided to enable the user to record calls or other matters to be attended to at particular times on a given day. In addition, a left-hand portion 120 is provided to enable the calls to be made on a particular day to be recorded in serial form. Thus, when an individual who has been contacted requests the worker to call again on a succeeding day, the daily call calendar may be opened to that particular day and the individual's name may be entered on an appropriate sheet as required. Thus, as the worker begins each day, he or she can readily determine the calls for which commitments have been made on the particular day.

Although the foregoing invention has been described in some detail by way of illustration and example, changes in form and the substitution of equivalents are contemplated as circumstances may suggest or render expedient; and although specific terms have been employed herein, they are intended in a descriptive sense and not for purposes of limitation, the scope of the invention being delineated in the following claims.

What is claimed is:

1. A project-organizing workbook for maintaining informational data regarding individuals and records of contacts therewith in readily available form, comprising:

a first and second portion hingedly connected in book-like form along a binder portion therebetween, the binder portion including a plurality of annular rings having a substantially rectangular cross-section;

a plurality of alphabetically-ordered, information cards releasably attached to the binder portion and overlying said first portion, the information cards including linear indicia adapted to record the names and other data regarding said individuals, and to serve as a register of a summary of contacts therewith, the information cards including a plurality of aperatures along a resilient edge thereof, each of said apertures having a slot which extends through the resilient edge, the apertures engaging the rings to retain the card in the workbook and the slot allowing the information cards to be withdrawn from the binder by the movement of the rings through the slot in the resilient edge portion;

a daily schedule of sequential calendar sheets attached to one of the portions adapted for the recording of prearranged communications made with certain individuals on particular days;

a daily call record or sequential sheets attached to one of the portions and adapted for the recording of the number of communications made on a particular day and the results of each communications; and a plurality of pockets each labelled according to a specific project and disposed in the second portion, the pockets adapted for retaining identification cards regarding certain of said individuals according to a specific project, the cards adapted to identify a portion of said individuals to be contacted with regard to specific matters and to record information regarding said matters.

2. A project-organizing workbook for maintaining informational data regarding individuals in readily available form, comprising:

a first and second portion hingedly connected in book-like form along a binder portion therebetween, the binder portion including a plurality of annular rings;

a plurality of alphabetically-ordered information cards releasably attached to the binder portion and capable of overlying said first portion, the information cards including linear indicia adapted to record the names and other data regarding said individuals, and to record data regarding an occurrence regarding which an individual is to be contacted and wherein each information card is initially joined to an identification card along a perforated line therebetween and adapted to be separated along the perforated line after the individual's name and data are recorded; and a plurality of pockets disposed in said second portion, the pockets for retaining identification cards which serve to identify certain of the individuals, and which contain the individual's name and data regarding said occurrence, thereby serving as prompts to identify a portion of said individuals to be contacted in connection with the occurrence;

wherein the information cards include a plurality of apertures along a resilient edge thereof, each of said apertures having a slot which extends through the resilient edge, the apertures engaging the rings to retain the card in the workbook, and the slot allowing the information cards to be withdrawn from the binder by the movement of the rings through the slot in the resilient edge portion.

3. A workbook according to claim 2 wherein each of the pockets is labelled according to a specific time period, and the identification cards are to be inserted therein according to the date of the occurrence.

4. A workbook according to claim 2 wherein each of the annular rings is formed from having a substantially rectangular cross-section.

* * * * *